US007356122B2

(12) United States Patent
Raber et al.

(10) Patent No.: US 7,356,122 B2
(45) Date of Patent: Apr. 8, 2008

(54) X-RAY ANODE FOCAL TRACK REGION

(75) Inventors: Thomas Raber, Schenectady, NY (US); Bernard Bewlay, Schenectady, NY (US); Andrew Trimmer, Latham, NY (US); Bin Wei, Mechanicville, NY (US); Colin R. Wilson, Niskayuna, NY (US); Mark Benz, Lincoln, VT (US); Ernest Balch, Ballston Spa, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/419,078

(22) Filed: May 18, 2006

(65) Prior Publication Data

US 2007/0269015 A1 Nov. 22, 2007

(51) Int. Cl.
*H01J 35/10* (2006.01)

(52) U.S. Cl. ..... 378/144; 378/129

(58) Field of Classification Search ..... 378/119, 378/125–129, 143, 144
See application file for complete search history.

(56) References Cited

U.S. PATENT DOCUMENTS

| | | | | |
|---|---|---|---|---|
| 3,751,702 | A | | 8/1973 | Dietz |
| 4,309,637 | A | | 1/1982 | Fetter |
| 4,455,504 | A | | 6/1984 | Iversen |
| 4,991,194 | A | | 2/1991 | Laurent et al. |
| 5,065,419 | A | * | 11/1991 | Leguen et al. ..... 378/125 |
| 5,148,463 | A | | 9/1992 | Woodruff et al. |
| 5,541,975 | A | | 7/1996 | Anderson et al. |
| 5,629,970 | A | | 5/1997 | Woodruff et al. |
| 5,722,870 | A | | 3/1998 | Raber et al. |
| 6,005,918 | A | | 12/1999 | Harris et al. |
| 6,115,454 | A | | 9/2000 | Andrews et al. |
| 2004/0208288 | A1 | | 10/2004 | Lenz |

FOREIGN PATENT DOCUMENTS

| | | |
|---|---|---|
| EP | 1047100 A3 | 2/2003 |
| JP | 2172149 A | 7/1990 |

OTHER PUBLICATIONS

M. Datta, "Applications of Electrochemical Microfabrication: An Introduction," vol. 42, No. 5, 1998, Electrochemical Microfabrication, 7 pages.
"Sample Preparation—Etching," 3 pages.
Daniel Paine et al., "Electrodeposited Resist—A Comparison Between Positive and Negative Resist," pp. 265-269.

(Continued)

*Primary Examiner*—Jurie Yun
(74) *Attorney, Agent, or Firm*—Eileen W. Gallagher; Curtis B. Brueske

(57) ABSTRACT

A focal track region of an x-ray anode in an example is electrochemically etched. In a further example, an x-ray anode comprises a thermally-compliant focal track region for impingement of electrons from an x-ray cathode to create an x-ray source. The thermally-compliant focal track region comprises a pattern of discrete relative expanses and gaps.

4 Claims, 7 Drawing Sheets

OTHER PUBLICATIONS

Wikipedia—Electrophoresis, 2 pages.
P.T. Tang et al., "Fabrication of Microcomponents by Electrochemical Manufacturing: Advanced Feed-Through Metallisation on Silicon and Nickel Micromechanical Resonators," 7 pages.
General Description of Electrochemical Machining (ECM), 15 pages.
Wikipedia—Molybdenum, 2 pages.
Wei Zheng et al., "Non-Robotic Fabrication of Packaged Microsystems by Shape-and-Solder-Directed SElf-Assembly," 4 pages.
K. Keger et al., "Optimizing REmote Plasma Cleans Through Real-Time Process Monitoring," 10 pages.
Wikipedia—Photolithography, 4 pages.
E. Boellaard et al., "RF-Devices Realised in MEMS by Using Electrodepositable Photoresist," pp. 1-7.
Wikipedia—Rhenium, 3 pages.
Wikipedia—Rhodium, 4 pages.
Idris Elbakri, Statistical Reconstruction Algorithms for Polyenergetic X-ray Computed Tomography, 2003, 175 pages.
"Thungsten-Rhenium Thermocouples Calibration Equivalents," 2 pages.
"Tungsten-Rhenium Alloys," 2 pages.
Wikipedia—Tungsten, 5 pages.
Wikipedia—X-ray tube, 4 pages.
Hendricks, Henry et al., "Photoresist Application for 3D Features on Wafer Surfaces", Compound Semiconductor, Jun. 2003, pp. 1-3.
Tajadod, James et al., "Electrophoretic Photoresist Application for High Topography Wafer Surfaces", 2003 International Conference on Compound Semiconductor Mfg., pp. 1-4.

* cited by examiner

X-RAY ANODE FOCAL TRACK REGION

BACKGROUND OF THE INVENTION

The present invention relates generally to x-ray sources and, more particularly, to a surface of an x-ray source employable in diagnostic imaging.

Exemplary diagnostics devices comprise x-ray systems, magnetic resonance (MR) systems, ultrasound systems, computed tomography (CT) systems, positron emission tomography (PET) systems, and other types of imaging systems. Typically, in CT imaging systems, an x-ray source emits a fan-shaped beam toward a subject or object, such as a patient or a piece of luggage. Hereinafter, the terms "subject" and "object" shall include anything capable of being imaged. The beam, after being attenuated by the subject, impinges upon an array of radiation detectors. The intensity of the attenuated beam radiation received at the detector array is typically dependent upon the attenuation of the x-ray beam by the subject. Each detector element of the detector array produces a separate electrical signal indicative of the attenuated beam received by each detector element. The electrical signals are transmitted to a data processing system for analysis which ultimately produces an image.

Generally, the x-ray source and the detector array are rotated about the gantry opening within an imaging plane and around the subject. X-ray sources typically include x-ray tubes, which emit the x-ray beam at a focal point. X-ray detectors typically include a collimator for collimating x-ray beams received at the detector, a scintillator for converting x-rays to light energy adjacent the collimator, and photodiodes for receiving the light energy from the adjacent scintillator and producing electrical signals therefrom.

Typically, each scintillator of a scintillator array converts x-rays to light energy. Each scintillator discharges light energy to a photodiode adjacent thereto. Each photodiode detects the light energy and generates a corresponding electrical signal. The outputs of the photodiodes are then transmitted to the data processing system for image reconstruction.

In connection with the x-ray sources, an x-ray tube in an example comprises an enclosure in which is mounted an anode target adjacent to a cathode. The anode target in an example comprises a disk mounted to a drive shaft for rotation at high speeds. Formed on a face of the target is an annular focal track. The focal track of the anode in an x-ray system is impacted by high energy electrons emitted from the cathode. Exemplary cathodes comprise a tungsten coil, filament, and/or field emitter array. When the high energy electrons from the cathode strike the surface of the focal track of the anode, the electrons are decelerated by the high density focal track. Exemplary materials of the focal track comprise powder metallurgy tungsten or a tungsten-rhenium alloy.

The deceleration of the electrons from the cathode against the surface of the x-ray anode results in the x-ray source. This electron deceleration gives rise to emission of x-rays, secondary electrons, and the generation of heat in a relatively small surface zone, for example, less than 30 microns or micrometers beneath the surface of the focal track. The impinging electrons heat the focal track and in turn the remainder of the target to substantially high temperature during operation. The x-ray anode surface is exposed to significant thermal stress to generate the x-ray radiation, by being struck by the beam of high-energy electrons. The rapid heating of the small, thin surface zone causes a substantial increase in the local target surface temperature, and the generation of enormous thermal stresses that can lead to subsequent cracking of the focal track during thermal cycling, as occurs during repeated x-ray-scanning. The typical cracking that occurs is often called "mud-flat cracking." During heat up the target surface deforms plastically and during cool down the deformed region is subjected to tensile stresses and subsequent cracking if the tensile stress exceeds the fracture stress of the alloy.

Therefore, it would be desirable to promote an alleviation of thermal stress on the target anode surface with satisfactory performance of the x-ray source.

BRIEF DESCRIPTION OF THE INVENTION

The invention in an implementation encompasses a process. A focal track region of an x-ray anode in an example is electrochemically etched.

Another implementation of the invention encompasses an x-ray anode. The x-ray anode comprises a thermally-compliant focal track region for impingement of electrons from an x-ray cathode to create an x-ray source. The thermally-compliant focal track region comprises a pattern of discrete relative expanses and gaps.

A further implementation of the invention encompasses a CT system. The CT system comprises an x-ray source, a detector, and a data acquisition system (DAS). The x-ray source emits a beam of x-rays toward an object to be imaged. The detector receives x-rays emitted by the x-ray source. The data acquisition system (DAS) is operably connected to the detector. The x-ray source comprises a thermally-compliant x-ray anode focal track region for impingement of electrons from an x-ray cathode to create the beam of x-rays toward the object to be imaged. The thermally-compliant x-ray anode focal track region comprises a pattern of discrete relative expanses and gaps. The discrete relative expanses comprise a major dimension of 50 microns to 500 microns. The gaps comprise a depth of 10 microns to 20 microns. The gaps comprise a width of 3 microns to 20 microns.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Exemplary diagnostics devices comprise x-ray systems, magnetic resonance (MR) systems, ultrasound systems, computed tomography (CT) systems, positron emission tomography (PET) systems, and other types of imaging systems. Exemplary applications of x-ray sources comprise imaging, medical, security, and industrial inspection applications. The operating environment of an exemplary implementation comprises a 64-slice CT system. However, it will be appreciated by those skilled in the art that an exemplary implementation is equally applicable for use with single-slice or other multi-slice configurations. Moreover, an exemplary implementation is employable for the detection and conversion of x-rays. However, one skilled in the art will further appreciate that an exemplary implementation is employable for the detection and conversion of other high frequency electromagnetic energy. An exemplary implementation is employable with a "third generation" CT scanner and/or other CT systems. For illustrative purposes, an exemplary implementation described herein adds surface texturing, by any of a variety of approaches, to allow thermal-mechanical compliance of the anode focal track layer to the thermal gradient caused by the electron beam heating. In a further exemplary implementation, the surface texturing does not aid heat transfer. In a still further exemplary implementation, the system is in a vacuum so there is no turbulence or anti-fouling involved.

Figure 1:
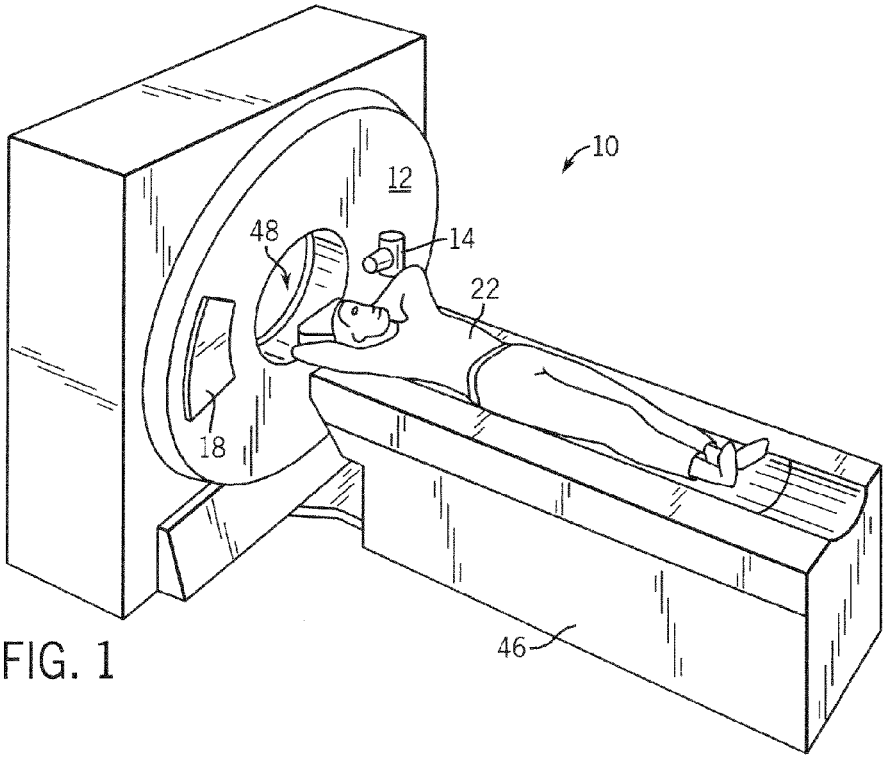
FIG. 1 is a pictorial view of a CT imaging system.
Figure 2:
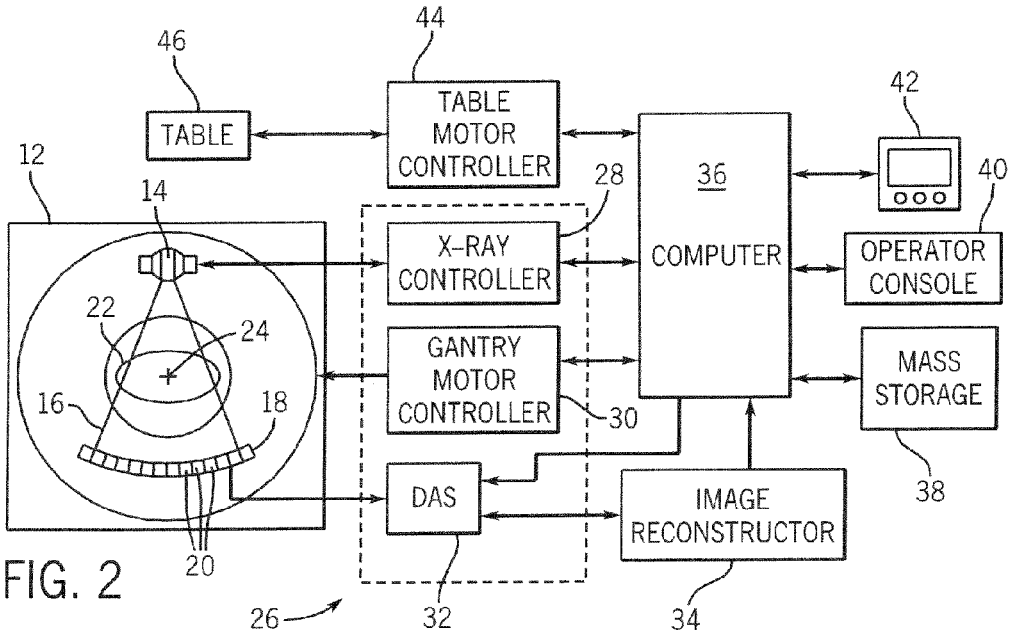
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray source 14 that projects a beam of x-rays 16 toward a detector array 18 on the opposite side of the gantry 12. Exemplary applications of the x-ray source 14 comprise imaging, medical, security, and industrial inspection applications. Detector array 18 is formed by a plurality of detectors 20 which together sense the projected x-rays that pass through a medical patient 22. Each detector 20 produces an electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. A data acquisition system (DAS) 32 in control mechanism 26 samples analog data from detectors 20 and converts the data to digital signals for subsequent processing. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves portions of patient 22 through a gantry opening 48.

Figure 3:
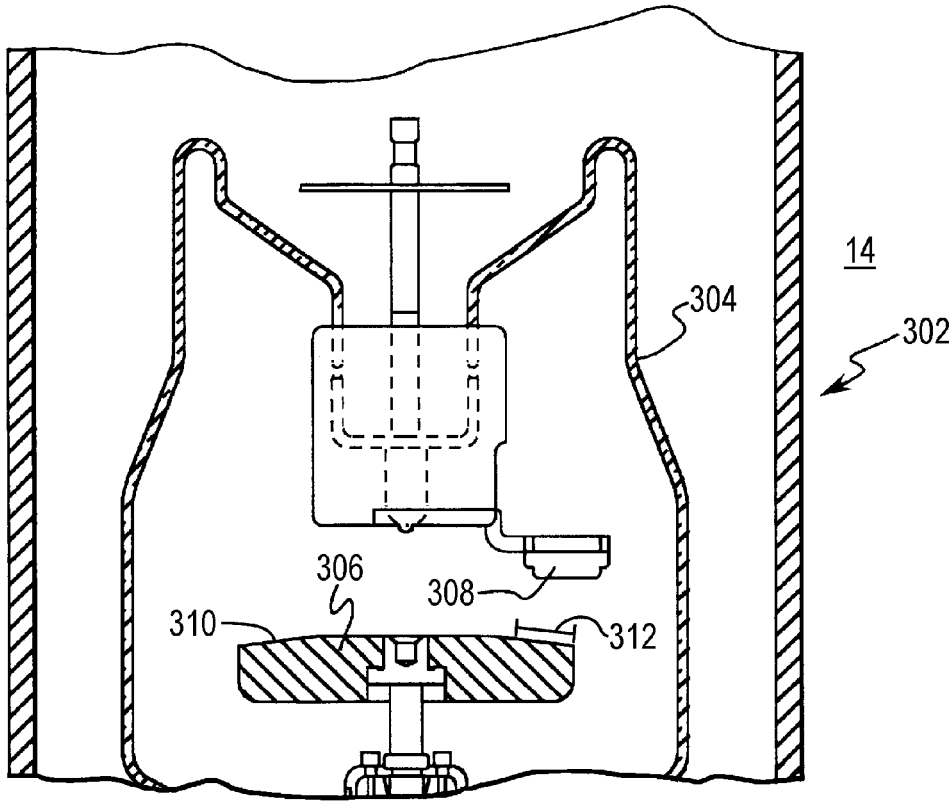
FIG. 3 is a partial, cutaway, schematic representation of an exemplary x-ray source such as for the system of FIG. 1.

Turning to FIG. 3, the x-ray source 14 in an example comprises an x-ray tube that comprises a casing 302 and a frame 304 in which are mounted an anode 306 as a target and a cathode 308 that is adjacent to the anode 306. For example, the x-ray tube as the x-ray source 14 comprises a hermetically sealed and substantially evacuated envelope that comprises an x-ray transparent material such as glass or stainless steel (SS) with a beryllium widow. The anode 306 in an example comprises a disk mounted to a drive shaft for rotation at high speeds, for example, about 140 Hz or 8400 rpm. In another example, the anode 306 is stationary and the electron beam from the cathode 308 is swept over an area of the anode 306 to distribute the heat, as will be appreciated by those skilled in the art.

Figure 4:
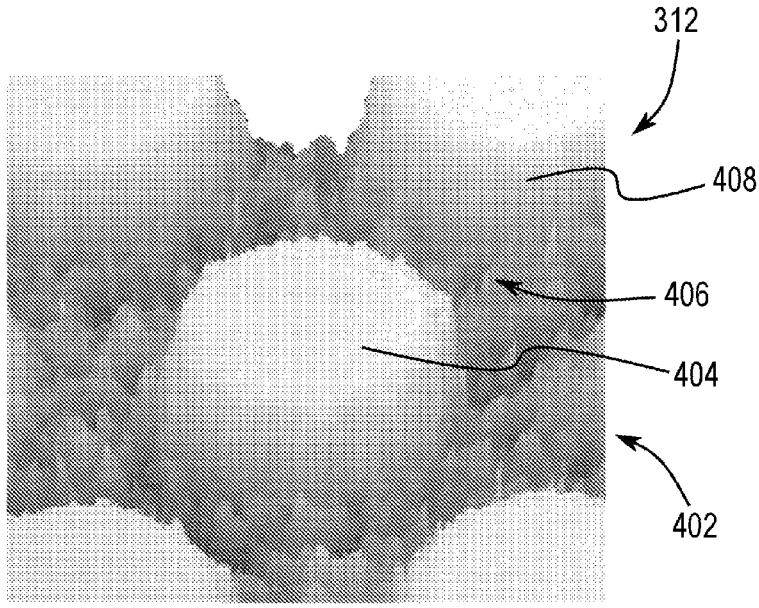
FIG. 4 is an enlarged, partial, perspective representation of a pattern on a focal track region of an x-ray source formed by electrochemical etching.

The anode 306 comprises a face 310 that comprises a focal track region 312. The focal track region 312 comprises a focal track as a target region against which a beam of high-energy electrons from the cathode 308 are bombarded for creation of the beam of x-rays 16 (FIG. 2). The focal track region 312 in an example is, for example, on an angled bevel. The angle of the bevel in an example comprises seven degrees. The electron beam from the cathode 308 impacts the focal track region 312, for example, at ninety-seven degrees. The exemplary seven degree angle allows distribution of heat over a broader area and allows enlargement of the view by the detector array 18. In another example, the degree of angle of the target as the focal track region 312 varies, for example, depending on the platform. An exemplary CT system comprises a seven to ten degree angle of the target as the focal track region 312 such as to cover an area that comprises a width of approximately seven to ten mm on the side toward the detector array 18. Exemplary larger focal track angles, for example, 11.25°, usable on vascular tubes may provide a larger fan beam to cover a larger x-ray detector area, for example, that comprises a width of approximately twenty to forty mm. The wider angle in an example reduces photon energy of the beam of x-rays 16 and reduces image detail, which of less concern in an exemplary vascular application. Exemplary implementation of the pattern 402 (FIG. 4; described herein) benefits an anode 306 with focal track angles ranging from approximately zero degrees to approximately thirty degrees from vertical, with the amount of electron beam energy from the cathode 308 deposited on the sidewall of the discrete relative expanses 404 (e.g., the relatively sharp transitions 408 such as of the mesas; FIG. 4; described herein) being beneficial. Heating of the sidewall areas as the relatively sharp transitions 408 in an example is not beneficial. An exemplary implementation reduces and/or minimizes exposure of the sidewall area as the relatively sharp transitions 408 to the electron beam from the cathode 308, thereby heating primarily and/or only the top surface as the discrete relative expanse 404. This is promoted in an example by using a narrower valley width dimension for the gaps 406.

The focal track of the focal track region 312 in an example comprises an annular target close to the edge of the face 310. The focal track region 312 of the anode 306 is exposed to significant thermal stress to generate the x-ray radiation as the beam of x-rays 16, by being struck by the beam of high-energy electrons from the cathode 308. The deceleration of the electrons against the focal track region 312 of the anode 306 results in the beam of x-rays 16. In exemplary x-ray production, ninety-nine percent of the incident energy is converted to heat. So, the dissipation of heat at the focal track region 312 is a significant limitation on the power which can be applied. By sweeping the focal track of the focal track region 312 under a focal spot of the beam of high-energy electrons from the cathode 308, the heat load can be spread over a larger area, increasing the power rating.

The impinging electron beam from the cathode 308 heats the focal track region 312 upon impact and in turn heats the remainder of the anode 306 to substantially high temperatures. For example, the focal track region 312 under the focal spot can reach 2500-2600° C. during an exposure, and the face 310 of the anode 306 can go from 300° C. to 1000° C. following a series of large exposures. The anode 306 comprises high temperature materials, for example, tungsten (W). The anode 306 in an example comprises a tungsten-rhenium (W—Re) target layer as the face 310 on a molybdenum (Mo) core, backed with graphite. In a further example, the anode 306 comprises pure tungsten (W) or tungsten-rhenium (W—Re) alloys, as well as Mo or rhodium (Rh) targets as the focal track region 312. The rhenium (Re) makes the tungsten (W) more ductile and resistant to thermal fatigue from impact of the electron beam from the cathode 308. The molybdenum (Mo) conducts heat from the focal track region 312 as the target. The graphite provides thermal storage for the anode 312, and reduces the rotating mass of the anode 306.

To increase the lifespan of the x-ray tube as the x-ray source 14, the anode 306 comprises a plate-like x-ray anode that rotates around its axis of symmetry. The electron beam from the cathode 308 strikes the rotating anode 306 in the radial outer region of the focal track region 312 close to the circumference of the anode 306. The rotation of the anode 306 continuously moves the focal track of the focal track region 312 under the focal spot that is fixed within the x-ray tube as the x-ray source 14. The focal track moves under the focal spot and the electrons of the electron beam from the cathode 308 do not always strike at the same location on the focal track in the focal track region 312 on the face 310 of the anode 306. When the electron beam from the cathode 308 with high energy density sweeps over the focal track, a powerful thermal shock can result and lead to a thermal fatigue and/or roughening of the focal track in the focal track region 312. Over the life of the anode 306, the focal track region 312 can develop cracks in the x-ray generating layer of tungsten-rhenium (W—Re) due to thermal-mechanical fatigue. This also results in a loss of x-ray output as the x-ray source 14 due to the surface roughening which occurs.

An exemplary implementation avoids mud-flat cracking of the focal track region 312. The face 310 in an example is modified. For example, the focal track region 312 is modified. In a further example, a process is provided for manufacturing the face 310, for example, in the focal track region 312.

Turning to FIGS. 4-6 and 10, the focal track region 312 in an example comprises a pattern 402. Exemplary surface engineering imparts a structural pattern as the pattern 402. An exemplary resultant structure as the pattern 402 comprises a thermally compliant focal track of the focal track region 312. The pattern 402 in an example comprises a textured surface where the electron beam from the cathode 308 impacts the focal track region 312 to allow thermal compliance from the extreme heating that occurs under the electron beam.

The pattern 402 in an example comprises a pattern of features. Exemplary features comprise discrete relative expanses 404 and gaps 406. The discrete relative expanses 404 in an example comprise relatively broad, substantially flat heads. For example, the discrete relative expanses 404 comprise substantially flat, circular and/or hexagonal heads as plateaus with cantilever steeply sloping support from a base, for example, the face 310. The gaps 406 in an example are bordered by relatively sharp transitions 408 from the discrete relative expanses 404. For example, the gaps 406 comprise open-faced passages on the face 310. The relatively sharp transitions 408 in an example comprise relatively steep declines from the discrete relative expanses 404. For example, the discrete relative expanses 404 and the relatively sharp transitions 408 resemble mesas, and the relatively sharp transitions 408 from the discrete relative expanses 404 cooperate to resemble valleys between the mesas. In a further example, the gaps 406 comprise trenches and/or grooves between the discrete relative expanses 404, with the relatively sharp transitions 408 of the trenches and/or grooves located immediately adjacent to the discrete relative expanses 404.

The open space in the valleys as the gaps 406 provides controlled expansion and controlled release of elastic energy during thermal cycling. The mesas as the discrete relative expanses 404 are allowed to expand more in a lateral plane direction of the face 310. Instead of the surface of the focal track in the focal track region 312 being extruded upward from the surface under the intense and rapid heating under the electron beam from the cathode 308, the surface can expand into the valley region as the gaps 406 and thereby prevent cracking.

In contrast, an unpatterned surface without the pattern 402 is constrained laterally. The material then cannot grow or expand outward so the material extrudes itself upward out of the plane of the face 310. Cooling creates a crack in the focal track region by placing the material under tensile stress. The crack continues to grow with each consecutive thermal cycle.

The space at the cracks as the gaps 406 provides controlled expansion and controlled release of elastic energy during thermal cycling. This provides a surface structure for controlled microcracking and prevention of large-scale uncontrolled macrocracking or "mud-flat" cracking. The pattern 402 provides for controlled release of the elastic energy during rapid thermal cycling during x-ray system operation. Unconstrained expansion of the material of the focal track region 312 of the face 310 into the gaps 406 prevents plastic deformation of the focal track region 312 during rapid thermal cycling. The pattern 402 prevents plastic deformation during thermal cycling and uncontrolled macro cracking, so called "mud-flat cracking," during x-ray target operation.

Exemplary texturing of the focal track region 312 in an example controls where the cracks start, rather than the cracks being random overall as in mud-flat cracking. The high region/low region arrangement as the pattern 402 in an example allows potentially higher electron beam powers to be used to produce high detail images. An exemplary limiting factor is amount of thermal-mechanical stress the anode 306 can endure before the anode 306 cracks so badly that the anode 306 is unusable, for example, as measured by radiation output from the x-ray source 14. For example, if a CT scan image is unacceptable due to radiation fall off, a doctor may turn up the electron beam intensity from the cathode 308, which turns up the heat on the anode 306 and shortens the life of the focal track region 312 on the face 310 of the anode 306.

Surface structuring of the focal track region 312 in an example accommodates thermal stress in a target layer on the anode 306. Mesa and valley approach. Superimpose trench pattern on end processed target, to allow the mesa to expand freely when the beam is exposed to (impinged on) the mesa. The tops of the mesas as the discrete relative expanses 404 are substantially orthogonal with the incidence of the electron beam from the cathode 308. The tops of the mesas as the discrete relative expanses 404 will therefore be heated the most. The mesas as the discrete relative expanses 404 in an example are less sensitive to the thermal expansion and contraction because of the pattern 402 on the focal track region 312. Desire to keep the anode surface area, such as the flats of the mesas as the discrete relative expanses 404, for emission of x-rays upon the electron impact from the cathode 308. The pattern 402 structures the focal track region 312 for durability.

Figure 5:
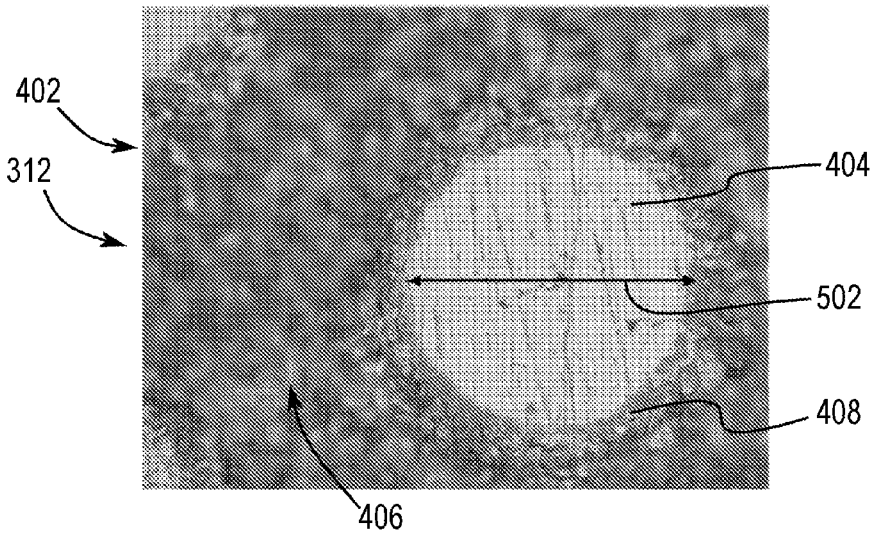
FIG. 5 is a top, partial representation of the focal track region of FIG. 4.

Referring to FIG. 5, an exemplary major dimension and/or diameter 502 of the discrete relative expanse 404 comprises fifty microns to five hundred microns. An exemplary depth of the gap 406 comprises ten microns to twenty microns. An exemplary width of the gap 406 comprises three microns to twenty microns. The terminology micron, micrometer, and μm all refer to $10^{-6}$ meter (m).

Figure 6:
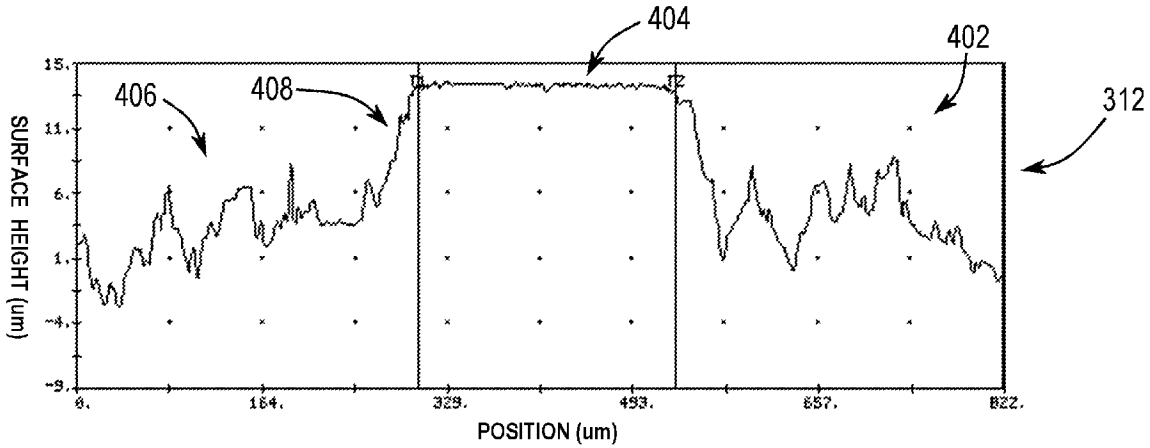
FIG. 6 is a profile representation of the focal track region of FIG. 4.

Referring to FIGS. 4-6, the pattern 402 in an example comprises a topography applied to the face 310 by electrochemical etching. FIG. 4 illustrates the focal track region 312 after electrochemical etching showing a mesa/valley pattern as the pattern 402. Exemplary mesa/valley surface engineering comprises fabrication by electrochemical machining (ECM) and pattern masking by lithography. Electrochemical surface texturing in an example is employed for the pattern 402 of the focal track region 312.

One example of surface engineering involves imparting a pattern of mesas and valleys as the discrete relative expanses 404 and the gaps 406 of the pattern 402 via ECM methods and lithography masking on the focal track region 312. For example, a mask such as lithographic mask (not shown) defines a shape in the form of the pattern 402 on resist 802 (FIG. 8) and electrochemical etching completes the fabrication of a mesa/valley pattern as the pattern 402 on the focal track region 312. Exemplary patterning with lithographic masks (not shown) coupled with ECM is a through mask etching (anodic) process. An additional exemplary approach for producing the mesa and valley pattern as the discrete relative expanses 404 and the gaps 406 of the pattern 402 is electrochemical etching utilizing potential pulses applied between a tool electrode (not shown) and the focal track region 312. For example, a pulsed power supply (not shown), for example, an AC or DC pulsed power supply, may be employed. The tool electrode in an example comprises a flat plate. For example, the tool electrode relies on the masking to define the region of material removal for the pattern 402. In another example, the tool electrode has the negative mesa/valley pattern imparted on the tool for transfer to the focal track region 312 via the resulting electrochemical process, as will be appreciated by those skilled in the art. Using a counter electrode (not shown) with the negative mesa/valley pattern as a tool electrode in an example does not require masking to form the pattern on the focal track region 312. For example, the counter electrode in an example is shaped as the negative pattern of the focal track region 312 and imparts the pattern 402 by direct electrochemical action. A further example employs electrical discharge machining (EDM). EDM in an example employs a patterned sinker to produce a patterned focal track surface as the pattern 402 on the focal track region 312. For example, a die (not shown) may be employed to create the patterned focal region as the focal track region 312 by EDM.

The pattern 402 on the focal track region 312 provides thermal-mechanical stress compliance of the focal track material to the extreme temperature rise associated with the electron beam from the cathode 308. The application of pattern 402 can be readily applied to existing target designs for the anode 306. Lab scale testing shows decreased tendency to cracking of focal track material when the pattern 402 is present at the focal track region 312. ECM provides parallel processing of multiple candidate targets in the focal track region 312. Parallel processing of multiple anodes 306 with pattern 402 can be accomplished by appropriate design and fabrication of ECM systems. Exemplary items for ECM processes comprise appropriately sized power supplies, electrolyte handling equipment, etc., as will be appreciated by those skilled in the art.

Figure 7:
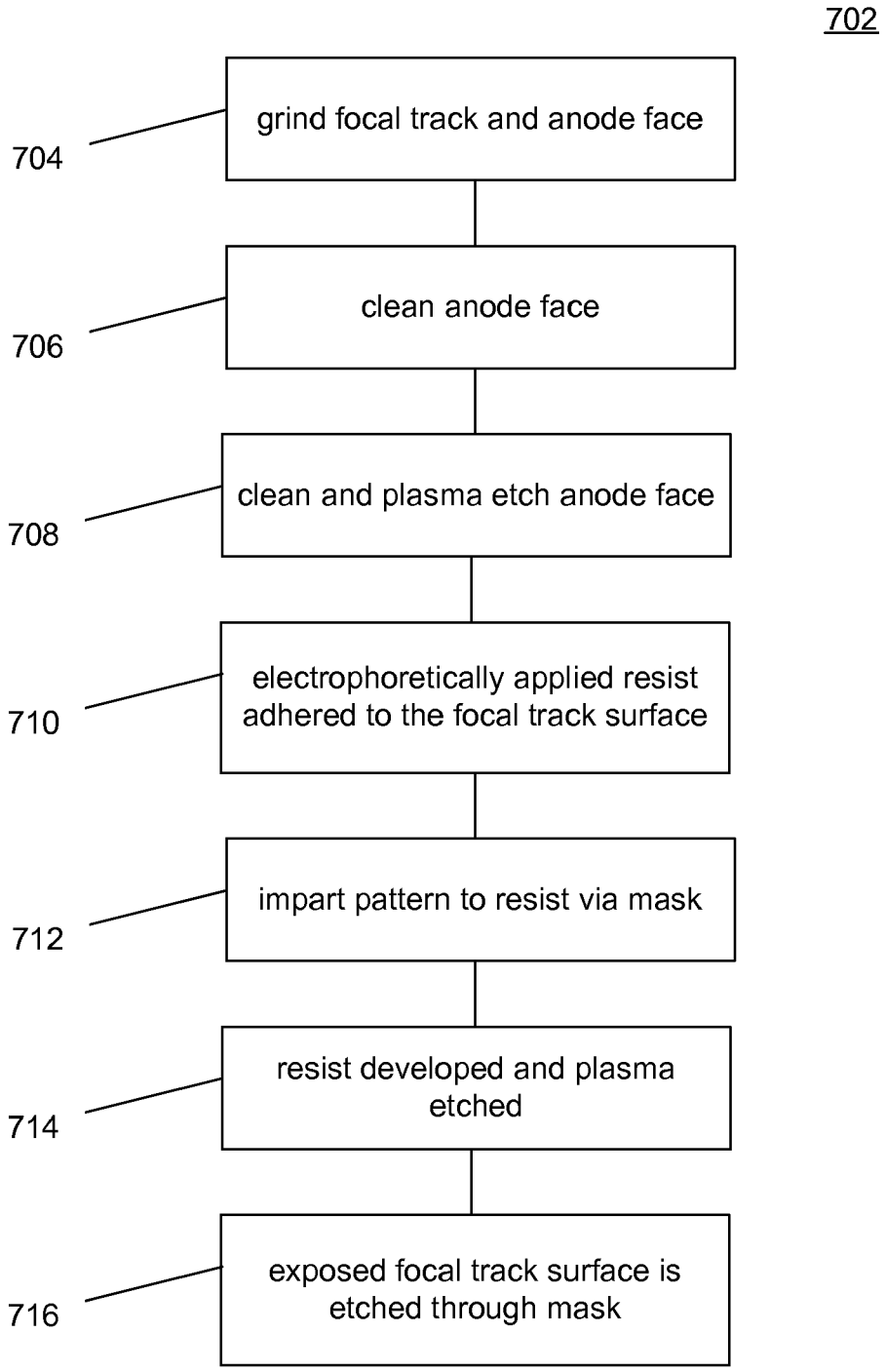
FIG. 7 is a representation of an exemplary process for electrochemical etching of the focal track region of FIG. 4.

Turning to FIG. 7, in exemplary process 702, STEP 704 grinds the focal track of the focal track region 312 and the remainder of the face 310. STEP 706 cleans the face 310 with a mixture of acetone and isopropyl alcohol solvent followed by a rinse with deionized water. STEP 708 further cleans the face 310 with lithographic type solvents and plasma etches the face 310. At STEP 710 an electrophoretically applied resist (802) is adhered to the focal track surface of the focal track region 312. STEP 712 imparts the desired shape in the form of the pattern 402 to the resist 802 via flood exposure through a mylar mask (not shown) containing the shape of the pattern 402. At STEP 714 following flood exposure, the resist 802 is developed and again plasma etched. At STEP 716, the resulting exposed focal track surface of the focal track region 312 is etched through the mask by either direct applied potential or potential pulses.

Exemplary ECM dissolves material through electrochemical reaction. This differs from physical machining where force is put on a surface. ECM in an example provides less chance of causing micro-cracks that would lead to start of mud-flat cracking on the focal track region 312. In a further example, ECM provides better control of depth/pattern of etching for the pattern 402. ECM in an example avoids undesired changes to the target as the focal track region 312, is cleaner, and/or makes easier mass production of the pattern 402. Multiple anodes 306 in an example comprise the pattern 402. ECM in an example mass produces the mesas in parallel on a particular anode 306. In a further example, ECM mass produces multiple anodes 306 in parallel with multiple patterns 402.

ECM is defined by the region of the surface that is exposed to the electrolyte and the region of the surface that is masked from the electrolyte. One may apply surface topography to the focal track region 312 by electrochemical etching. The resist 802 in an example tolerates a sodium hydroxide electrolyte solution. Additional exemplary electrolyte solutions comprise hydrofluoric acid, hydrofluoric acid plus water, hydrogen peroxide, potassium hydroxide, ammonia hydroxide, any alkali hydroxide, and/or dilute hydrochloric (HCL) acid. An exemplary Ferricyanide based etchant is offered by Transene Company Inc., Danvers Industrial Park, 10 Electronics Avenue, Danvers, Mass. 01923 USA, http://www.transene.com/. Exemplary plasma etching and Reactive Ion Etching (RIE) employs CF4 O2 to etch, for example, Tungsten (W) films. Exemplary high rate plasma etching of Tungsten (W) in an example employs NF3 and Argon gases in a plasma etcher (not shown). An exemplary etch rates comprises 4512 angstrom (A) per minute.

An exemplary resist 802 comprises EAGLE 2100 ED offered by Rohm and Haas Electronic Materials, 455 Forest Street, Marlborough, Mass. 01752 USA, http://www.rohm-haas.com/; Product Family: Photoresist; Business Unit: Circuit Board Technologies; Product Description: Liquid Photoresist. Liquid photoresists are typically used for creating patterns on metallic substrates that will be etched or selectively plated with other metals. Rohm and Haas Electronic Materials offers positive and negative tone products that can be applied by dip, spray, screen, roller or electrodeposition (ED). The Photoposit™ resist product line leads the market globally in liquid photoresist technology with such capabilities as: Wide process latitude through exposure and develop; Extremely fine features resolution (<10 microns Line/Space); High process yields achieved through tough, hard coatings; Three dimensional and/or electrophoretic coatings with the ED products. In ED, the photoresist as the resist 802 comprises charged micelles in an aqueous bath. Much like in metal electroplating, a charge is applied to the part, attracting the photoresist micelles and coating all conductive surfaces. These micelles become neutralized at the part's surface and will later be fused to form a uniform light-sensitive coating. Additional exemplary resists 802 comprise epoxy based electrophoretic photoresists such as those offered by Shipley Company, L.L.C., a subsidiary of Rohm and Haas Company, Marlborough, Mass. or PPG Industries, PPG World Headquarters, One PPG Place, Pittsburgh, Pa. 15272 USA http://corporateportal.ppg.com/ppg/. Further exemplary resists 802 comprise Negative Polyisoprene and Polyvinyl Cinnamate. Still further exemplary resists 802 comprise photoresists such as Kodak KMER, KTFR, KPR, Kodak 747, Kodak 752 or Hunt Waycoat HR-100 (Eastman Kodak Co., 343 State Street, Rochester, N.Y. 14650 USA, http://www.kodak.com). HR-200 type resists could be used with a spray coat or dipcoat application method. Where an exact resist is no longer marketed similar resists might be available. It is also be possible to use an otherwise incompatible photoresist to pattern a dielectric "transfer mask" layer (previously deposited over the W-Rhenium). The dielectric mask is then used to define the etched areas. This two step approach would remove the alkali resistant requirements and allow other more commonly available resists to be used.

Figure 9:
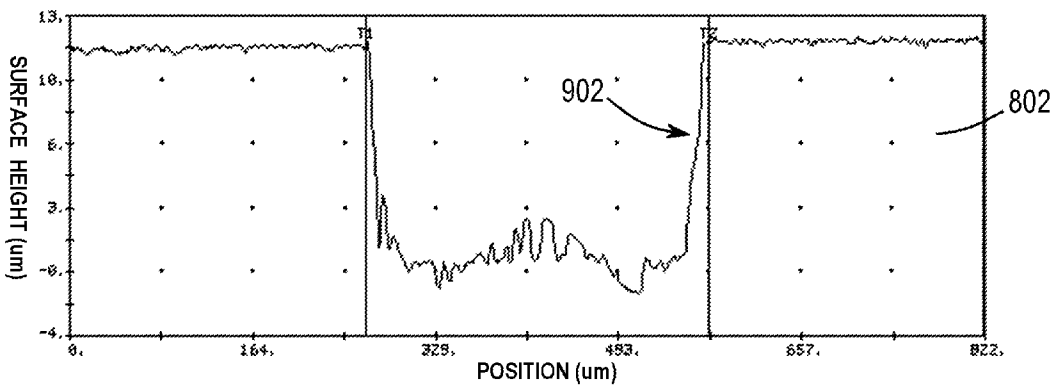
FIG. 9 is similar to FIG. 8 as a profile, partial representation of the focal track region and the etch mask on the resist before electrochemical etching.
Figure 8:
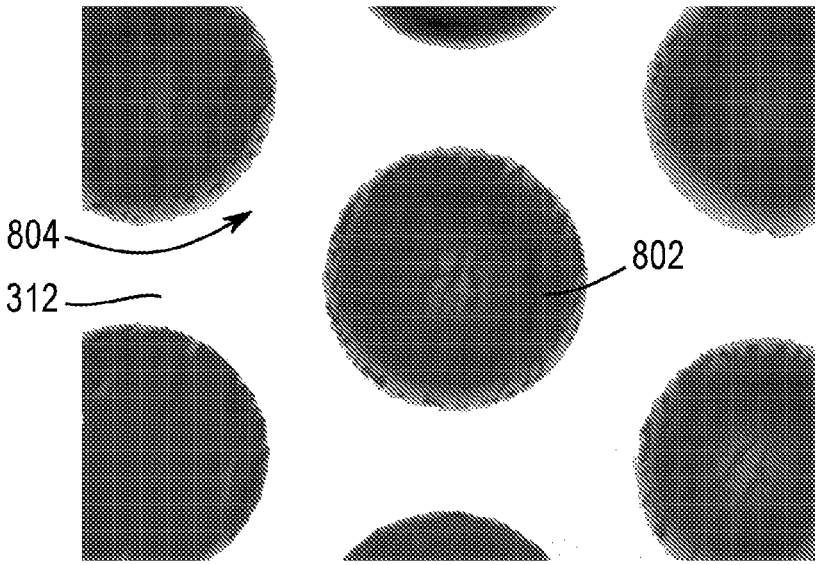
FIG. 8 is a top, partial representation of the focal track region of FIG. 4 and an etch mask on a resist before electrochemical etching.

FIG. 8 is a top, partial representation of the focal track region 312 and the patterned resist 802 before electrochemical etching. FIG. 9 is similar to FIG. 8 as a profile, partial representation of the focal track region 312 and the patterned resist 802 before electrochemical etching. In FIG. 8, an exemplary surface as the focal track region 312 is patterned using a resist 802 patterned through a mask application process as in the process 702 (FIG. 7) with EAGLE 2100 ED as the resist 802. FIG. 9 is a topographic representation of EAGLE 2100 ED as the resist 802 on the focal track region 312. The elevated regions of FIG. 9 correspond to the circular regions of the resist 802 shown in FIG. 8. and directly influence the elevated mesa/valley profile of the focal track surface of the focal track region 312 by masking the discrete relative expanses 404. The separations 804 become the valleys as the gaps 406 after ECM etching. FIG. 9. illustrates an exemplary property of the resist 802 to comprise mask walls 902 that comprise a relatively high aspect ratio. Straight walls as the mask walls 902 in an example serve as an exemplary quality of the mask as the resist 802, for example, to produce a more consistent surface of the focal track region 312 during the ECM process.

Another example of surface engineering involves imparting a pattern of mesas and valleys as the discrete relative expanses 404 and the gaps 406 of the pattern 402 via lithographic masking and electrochemical metal deposition on the focal track region 312. Exemplary patterning with lithographic masks (not shown) coupled with electrochemical metal deposition comprises a cathodic process where an exposed target surface as the focal track region 312 is built up to create the pattern 402, as will be appreciated by those skilled in the art. For example, metal ions in an electrolyte solution are reduced on an exposed target surface intended for the focal track region 312 creating a pattern of mesas and valleys as the pattern 402. Exemplary mesa/valley surface engineering for the pattern 402 comprises fabrication by pattern masking by lithography and electrochemical metal deposition. Electrochemical metal deposition coupled with lithographic masks provides parallel processing of multiple candidate targets in the focal track region 312. Multiple mesas of the pattern 402 in an example are parallel processed on a particular anode 306. Multiple anodes 306 in an example are parallel processed with patterns 402 that comprise multiple mesas.

Figure 10:
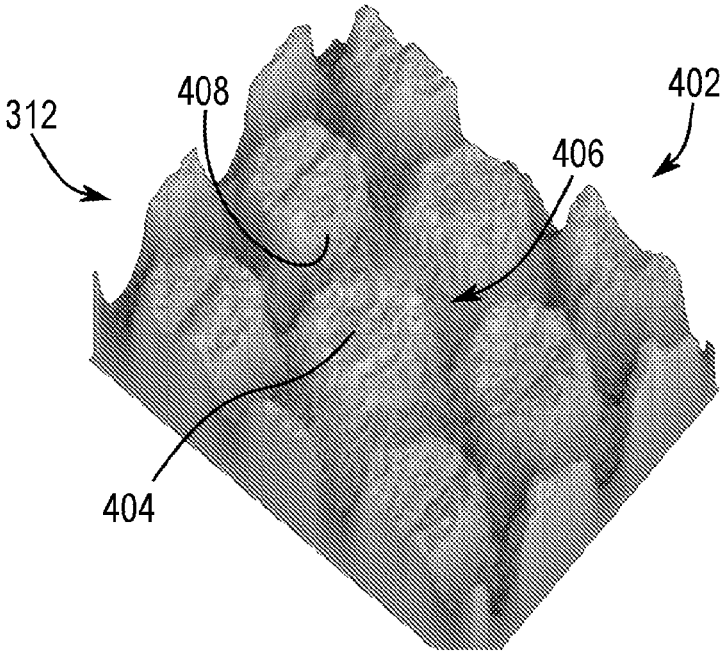
FIG. 10 is an enlarged, partial, perspective view of a pattern on a focal track region of an x-ray source formed by laser ablation.

Referring to FIG. 10, a further example of surface engineering involves laser glazing/melting/ablation of a pattern of grooves and cracks to provide the discrete relative expanses 404 and the gaps 406 of the pattern 402 on the focal track region 312. For example, the pattern 402 is generated by laser melting locally and on a scale of about 10 microns an arrangement of grooves and cracks on the focal track region 312. A lab scale test of fabrication and evaluation showed samples made with the pattern 402 via laser processing had superior performance to an unpatterned design.

Figure 11:
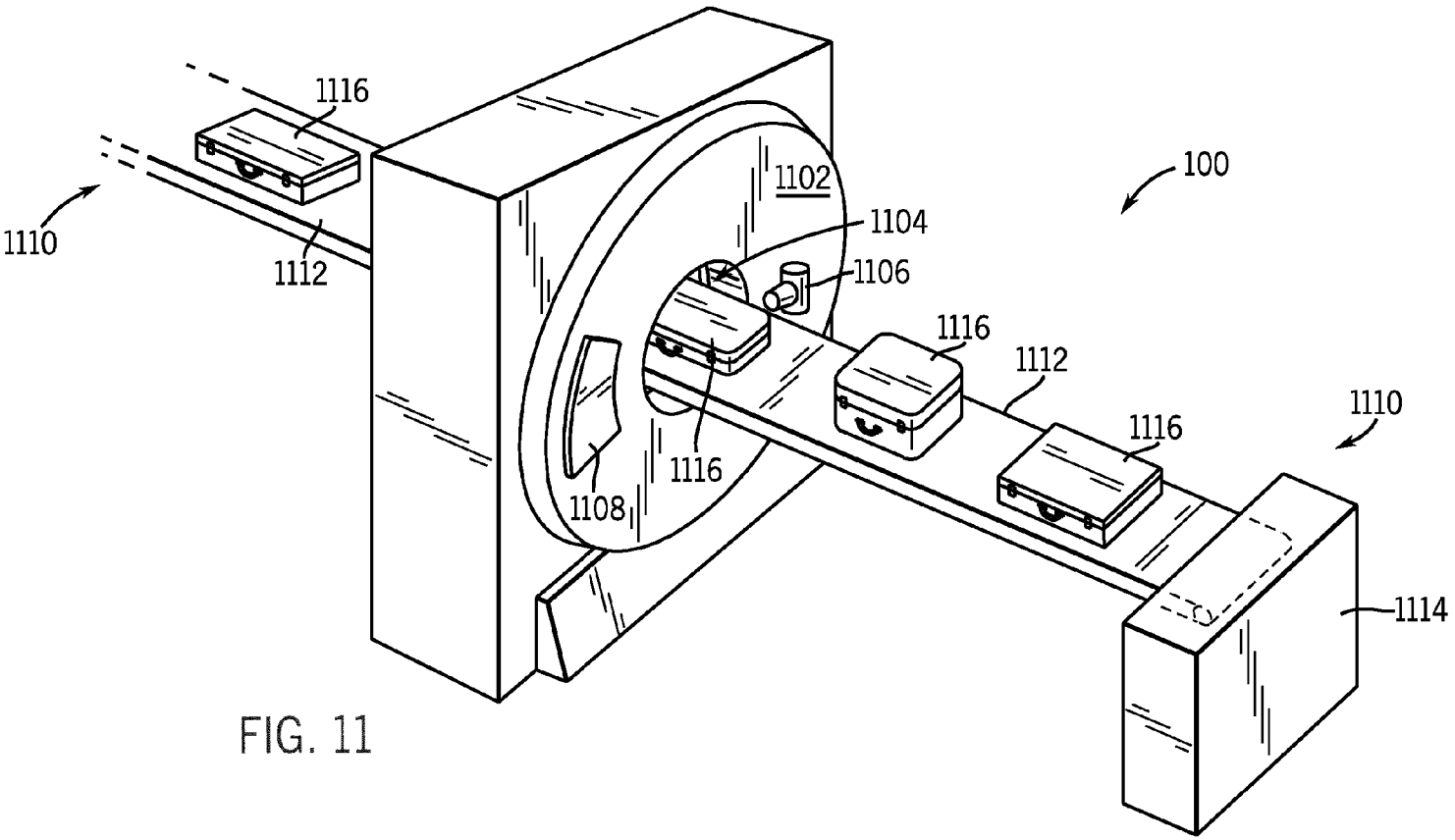
FIG. 11 is a pictorial view of a CT system for use with a non-invasive package inspection system.

Referring now to FIG. 11, package/baggage inspection system 100 includes a rotatable gantry 1102 having an opening 1104 therein through which packages or pieces of baggage may pass. The rotatable gantry 1102 houses an x-ray and/or high frequency electromagnetic energy source 1106 as well as a detector assembly 1108 having scintillator arrays comprised of scintillator cells. A conveyor system 1110 is also provided and includes a conveyor belt 1112 supported by structure 1114 to automatically and continuously pass packages or baggage pieces 1116 through opening 1104 to be scanned. Objects 1116 are fed through opening 1104 by conveyor belt 1112, imaging data is then acquired, and the conveyor belt 1112 removes the packages 1116 from opening 1104 in a controlled and continuous manner. As a result, postal inspectors, baggage handlers, and other security personnel may non-invasively inspect the contents of packages 1116 for explosives, knives, guns, contraband, etc.

In an exemplary implementation, a focal track region 312 of an x-ray anode 306 in an example is electrochemically etched. There is electrochemically texturing the focal track region 312 of the x-ray anode 306 to create thermal mechanical stress compliance of the focal track region 312 to an extreme temperature rise associated with an electron beam impinging the focal track region 312 for production of x-rays 16.

There is electrochemical machining in parallel a plurality of pattern features 402 of the focal track region 312 of the x-ray anode 306. There is electrochemical machining in parallel: a plurality of pattern features 402 of the focal track region 312 of the x-ray anode 306; and a plurality of pattern features 402 of a focal track region 312 of a second x-ray anode 306.

There is electrochemical machining the focal track region 312 of the x-ray anode 306 to comprise a pattern 402 of discrete relative expanses 404 and gaps 406. There is electrochemical machining in parallel a plurality of discrete relative expanses 404 and gaps 406 in a pattern 402 of the focal track region 312 of the x-ray anode 306. There is electrochemical machining in parallel: a plurality of discrete relative expanses 404 and gaps 406 in a pattern 402 of the focal track region 312 of the x-ray anode 306; and a plurality of discrete relative expanses 404 and gaps 406 in a pattern 402 of a focal track region 312 of a second x-ray anode 306.

There is electrochemical etching a major feature 404 to comprise a major dimension 502 of 50 microns to 500 microns. There is electrochemical etching a minor feature 406 to comprise a major dimension of 3 microns to 20 microns. There is electrochemical etching a mesa/valley pattern 402 on the focal track region 312 of the x-ray anode 306.

There is placing a resist 802 for a pattern 402 of the focal track region 312 of the x-ray anode 306 in an electrolyte solution that comprises one or more of sodium hydroxide, hydrofluoric acid, hydrofluoric acid plus water, hydrogen peroxide, potassium hydroxide, ammonia hydroxide, an alkali hydroxide, and/or dilute hydrochloric acid. There is applying a pattern resist 802 to the focal track region 312 of the x-ray anode 306 by electrodeposition ED.

In an exemplary implementation, an x-ray anode 306 comprises a thermally-compliant focal track region 312 for impingement of electrons from an x-ray cathode 308 to create an x-ray source 14. The thermally-compliant focal track region 312 comprises a pattern 402 of discrete relative expanses 404 and gaps 406.

The discrete relative expanses 404 comprise relatively broad, substantially flat heads 404. The discrete relative expanses 404 comprise substantially flat, circular and/or hexagonal heads 404 as plateaus 404 with cantilever steeply sloping support 408 from a base 310. The pattern 402 of discrete relative expanses 404 and gaps 406 comprises a mesa/valley pattern 402. The discrete relative expanses 404 are circumscribed by relatively sharp transitions 408 that delineate the gaps 406.

The discrete relative expanses 404 comprise a major dimension 502 of 50 microns to 500 microns. The gaps 406 comprise a depth of 10 microns to 20 microns. The gaps 406 comprise a width of 3 microns to 20 microns.

In an exemplary implementation, a CT system 10 comprises an x-ray source 14, a detector 18, and a data acquisition system (DAS) 32. The x-ray source 14 emits a beam of x-rays 16 toward an object 22 to be imaged. The detector 18 receives x-rays 16 emitted by the x-ray source 14. The data acquisition system (DAS) 32 is operably connected to the detector 18. The x-ray source 14 comprises a thermally-compliant x-ray anode focal track region 312 for impingement of electrons from an x-ray cathode 308 to create the beam of x-rays toward the object 22 to be imaged. The thermally-compliant x-ray anode focal track region 312 comprises a pattern 402 of discrete relative expanses 404 and gaps 406. The discrete relative expanses 404 comprise a major dimension 502 of 50 microns to 500 microns. The gaps 406 comprise a depth of 10 microns to 20 microns. The gaps 406 comprise a width of 3 microns to 20 microns.

The gaps 406 comprise trenches 406 and/or grooves 406 between the discrete relative expanses 404. The discrete relative expanses 404 are located immediately adjacent to relatively sharp transitions 408 of the trenches 406 and/or grooves 406. The pattern 402 of discrete relative expanses 404 and gaps 406 comprises a mesa/valley pattern 402.

An implementation of the system 10 and/or 100 in an example comprises a plurality of components such as one or more of electronic components, hardware components, chemical components, and/or computer software components. A number of such components can be combined or divided in an implementation of the system 10 and/or 100. An exemplary component of an implementation of the system 10 and/or 100 employs and/or comprises a set and/or series of computer instructions written in or implemented with any of a number of programming languages, as will be appreciated by those skilled in the art. An implementation of the system 10 and/or 100 in an example comprises any (e.g., horizontal, oblique, or vertical) orientation, with the description and figures herein illustrating an exemplary orientation of an implementation of the system 10 and/or 100, for explanatory purposes.

The steps or operations described herein are examples. There may be variations to these steps or operations without departing from the spirit of the invention. For example, the steps may be performed in a differing order, or steps may be added, deleted, or modified.

The present invention has been described in terms of the preferred embodiment, and it is recognized that equivalents, alternatives, and modifications, aside from those expressly stated, are possible and within the scope of the appending claims.

What is claimed is:

1. An x-ray anode, comprising:

a thermally-compliant focal track region for impingement of electrons from an x-ray cathode to create an x-ray source, wherein the thermally-compliant focal track region comprises a raised surface pattern of discrete relative expanses and gaps and wherein the discrete relative expanses comprise a major dimension of 50 microns to 500 microns, wherein the gaps comprise a depth of 10 microns to 20 microns, wherein the gaps comprise a width of 3 microns to 20 microns.

2. A CT system, comprising:

an x-ray source that emits a beam of x-rays toward an object to be imaged;

a detector that receives x-rays emitted by the x-ray source;

a data acquisition system (DAS) operably connected to the detector;

wherein the x-ray source comprises a thermally-compliant x-ray anode focal track region for impingement of electrons from an x-ray cathode to create the beam of x-rays toward the object to be imaged, wherein the thermally-compliant x-ray anode focal track region comprises a pattern of discrete relative expanses and gaps, wherein the discrete relative expanses comprise a major dimension of 50 microns to 500 microns, wherein the gaps comprise a depth of 10 microns to 20 microns, wherein the gaps comprise a width of 3 microns to 20 microns.

3. The CT system of claim 2, wherein the gaps comprise trenches and/or grooves between the discrete relative expanses, wherein the discrete relative expanses are located immediately adjacent to relatively sharp transitions of the trenches and/or grooves.

4. The CT system of claim 2, wherein the pattern of discrete relative expanses and gaps comprises a mesa/valley pattern.

* * * * *